US007935879B2

(12) United States Patent
Transeau

(10) Patent No.: US 7,935,879 B2
(45) Date of Patent: May 3, 2011

(54) METHOD AND APPARATUS FOR DIGITAL AUDIO GENERATION AND MANIPULATION

(75) Inventor: Brian Transeau, Los Angeles, CA (US)

(73) Assignee: Sonik Architects, Inc., Germantown, MD (US)

( * ) Notice: Subject to any disclaimer, the term of this patent is extended or adjusted under 35 U.S.C. 154(b) by 0 days.

(21) Appl. No.: 11/551,696

(22) Filed: Oct. 20, 2006

(65) Prior Publication Data

US 2008/0184868 A1 Aug. 7, 2008

(51) Int. Cl.
*G10H 7/00* (2006.01)

(52) U.S. Cl. ..... 84/604; 84/602; 84/609

(58) Field of Classification Search ..... 84/602, 84/604, 609

See application file for complete search history.

(56) References Cited

U.S. PATENT DOCUMENTS

| | | | | |
|---|---|---|---|---|
| 3,643,540 | A * | 2/1972 | Rosenstock et al. | 84/484 |
| 5,275,082 | A * | 1/1994 | Kestner-Clifton et al. | 84/477 B |
| 5,920,843 | A * | 7/1999 | Fay | 704/503 |
| 6,121,532 | A | 9/2000 | Kay | |
| 7,096,186 | B2 * | 8/2006 | Funaki | 704/278 |
| 2004/0196988 | A1 * | 10/2004 | Moulios et al. | 381/119 |
| 2006/0075887 | A1 * | 4/2006 | Shotwell et al. | 84/645 |
| 2006/0272480 | A1 * | 12/2006 | Gimarc | 84/600 |
| 2008/0041220 | A1 * | 2/2008 | Foust et al. | 84/625 |
| 2009/0281793 | A1 | 11/2009 | Transeau | |

OTHER PUBLICATIONS

"Information Disclsure" submitted by Attorney for Applicant.

* cited by examiner

*Primary Examiner* — Walter Benson
*Assistant Examiner* — Kawing Chan
(74) *Attorney, Agent, or Firm* — John May; Berliner & Associates

(57) ABSTRACT

A method and apparatus creates "micro edits" or alterations and manipulation of sounds, per track or per portion of a track in a "drum machine," thereby creating unique subdivisions of sound as well as providing means for panning sound within a two dimensional sound space.

7 Claims, 6 Drawing Sheets

FIG. 10
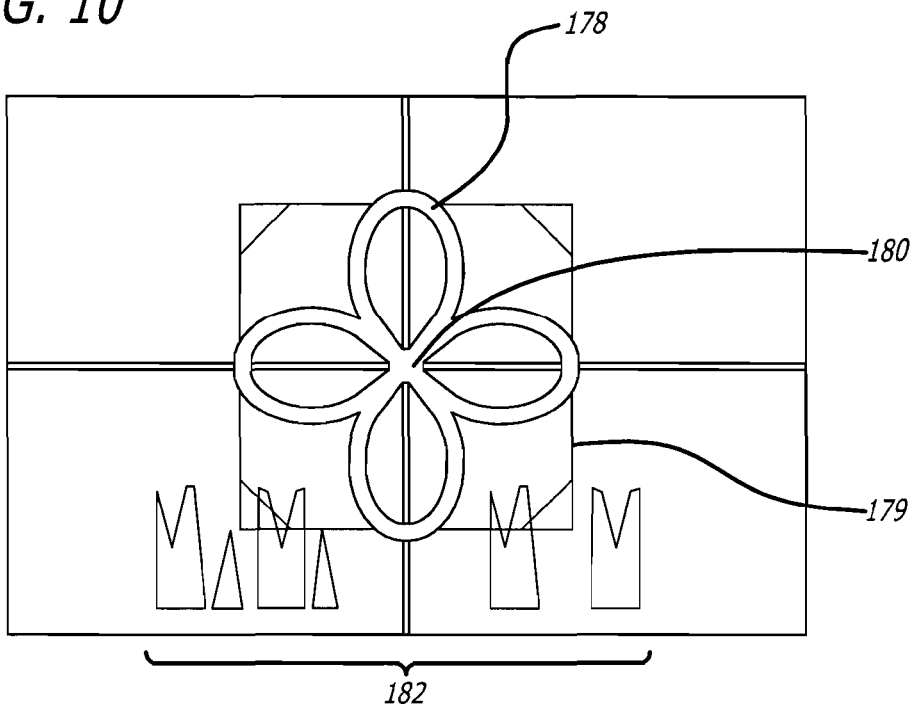
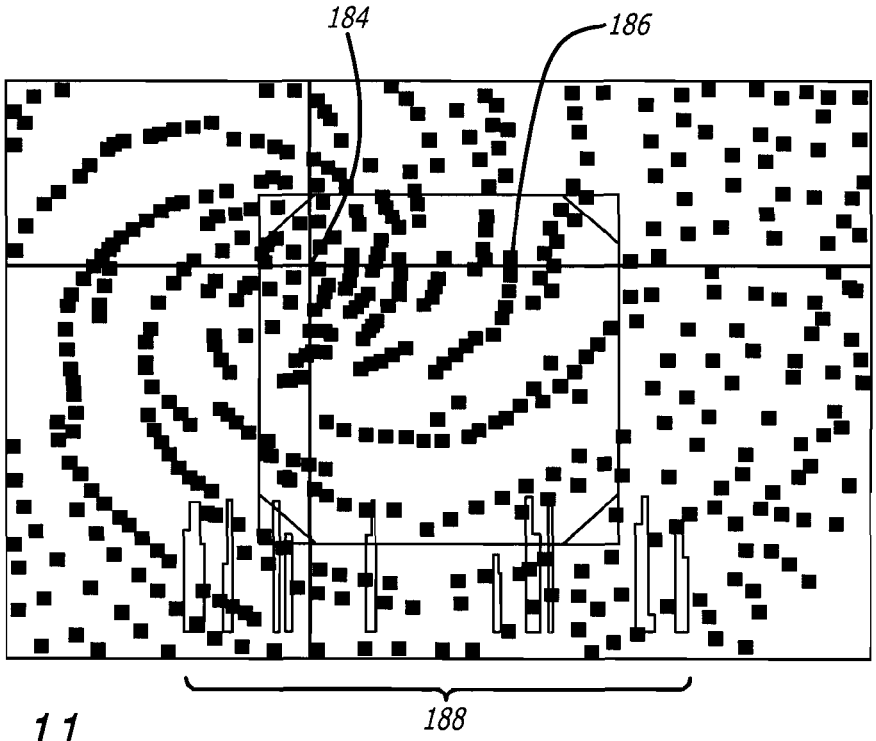
FIG. 11

METHOD AND APPARATUS FOR DIGITAL AUDIO GENERATION AND MANIPULATION

FIELD OF THE INVENTION

The present invention relates to electronic sound creation and more specifically to a method and apparatus for digital audio generation and manipulation.

BACKGROUND OF THE INVENTION

For virtually as long as there have been computers and electronic devices, various methods and apparatus have been created whereby sound may be created or manipulated by these means. Each successive improvement in electronic components, computing power or interface enhancement has resulted in an equally successive iteration of audio devices capable of various types of sound generation or manipulation.

Sound creation and manipulation began in the mainstream by utilizing electronic sound modification "boxes" in conjunction with instrument-created sound, such as "wah-wah" pedals and "voice boxes" for guitars. Following this, sound-creation devices began as simple electric pianos that became synthesizers in the 70's and 80's capable of generating or emulating sounds reminiscent of literally thousands of instruments, both real and imagined.

Subsequently, mixing devices capable of editing and manipulating (as well as outputting) multiple audio channels were used in conjunction with various effects to alter sounds in "post-production" and to provide "clean up" or embellishment of sounds after recording. Leaps forward in speaker technology have also propelled the use of stereo into "surround sound" while audio formats have gone from the analog format 8-track tapes and cassette tapes to digital formats such as Compact Discs to MP3 and DVD Audio.

The most recent major iteration has been the use of computers with sophisticated graphical user interfaces allowing literally infinite capability for sound manipulation. The use of these software products has provided further benefit to an individual user, providing the capability of thousands of dollars worth of studio equipment, musical instruments and even functionality previously unavailable on any studio equipment to be contained within a single software program residing on a digital computer.

However, in the prior art there has been a substantial limitation on the ability of these music-oriented sound software programs to subdivide individual tracks into smaller portions, then to edit those portions, including their time signatures, individually. There exists a further limitation in audio software whereby software, until now, has been incapable of selecting the loop playback of each track of an audio file independent of every other track. There further exists a limitation in the prior art whereby graphical, on-screen "placement" of "drum machine" generated sound within a Dolby® 5.1 sound context, utilizing a Cartesian plane, has, as-of-yet, been impossible through the use of software.

BRIEF SUMMARY OF THE INVENTION

According to the present invention a user of the software of the method and apparatus of the present invention may edit individual tracks (or portions of tracks) within an audio composition, including providing time signatures per track (or portion thereof). This invention provides software, through the use of a simple user interface, that allows the user to set the time signature for each track. Additionally, the user may further subdivide a track (or portion thereof) into portions of an entire audio event, these portions entitled "micro events." The software of this invention provides a simple user interface that uses an algorithm to subdivide a track (or portion thereof) into these "micro events" including adjustments for the slope of the amplitude and "gaps" in the sound waves to the user's specifications.

Additionally, a method is provided whereby a user may utilize controls to manipulate the placement of sounds within a "surround sound" environment of at least 4 speakers. This sound placement occurs visually on the graphical user interface within software. Using the interface a user may visually see the shape that the algorithm the user has selected will "sound" to a listener. An algorithm is then used to create this sound in the environment of a two dimensional space. The sound can be given "shapes" visually by a user such that it appears to be present at a certain place or a series of places or a line of places within a two dimensional space. In the preferred embodiment of this invention, sound is accepted from two channels and is output into six channels.

It is therefore an object of the this invention to provide the capability to alter individual portions of tracks within a sequencer. It is a further object of the present invention to provide the ability to loop each track independently of every other track in an audio composition, while assigning different time signatures per-track (or portion of a track). It is an additional object of the present invention to provide means by which computer-generated sounds may be "panned" within a two dimensional space, suitable for use with Dolby® 5.1 sounds (or other similar sound setup). These and other objects of the present invention will be seen from the following description.

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

BRIEF DESCRIPTION OF THE DRAWINGS

FIG. 10 is a graphical depiction of the placement of the sound within an example surround sound space.

FIG. 11 is another graphical depiction of the placement of sound within an example surround sound space.

DETAILED DESCRIPTION OF THE INVENTION

Figure 1:
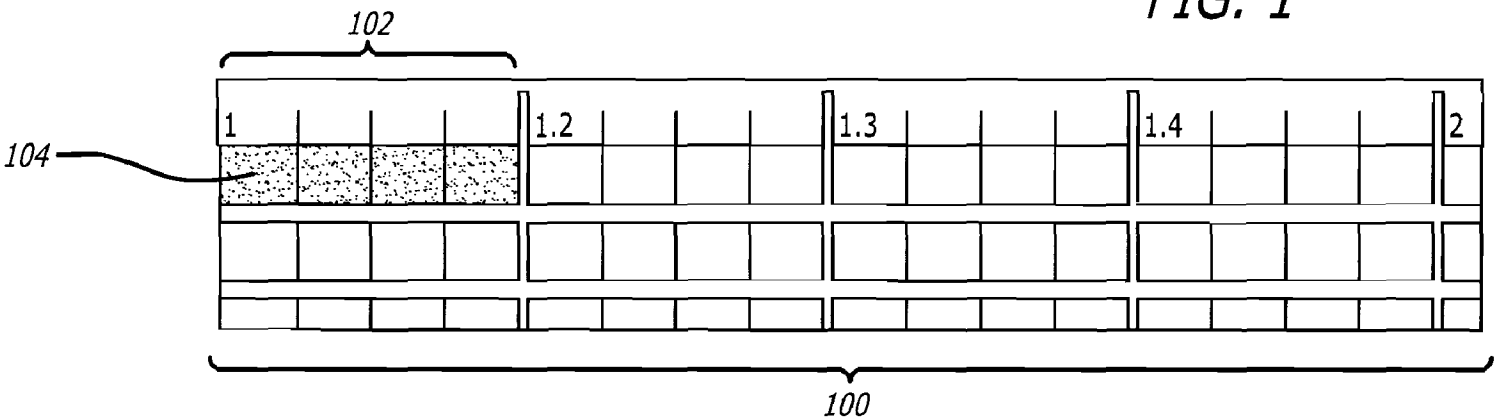
FIG. 1 is a graphical depiction of a one-track measure of sound in a preferred embodiment of the present invention.

Referring first to FIG. 1, there is shown a representation of a portion of the graphical user interface of the preferred embodiment. Element 100 is an entire measure of sound in 4/4 time. 4/4 time is the "time signature" in musical terminology, referring to the number of beats per measure and the type of note that corresponds to one beat. In 4/4 time, for example, a quarter note is one beat and four quarter notes make up a complete measure. Alternatively, in 3/4 time a quarter note is one beat and three quarter notes make up a complete measure. This methodology is common in the art and is very well known. In element 100, it is apparent that a measure is made up of four beats by noting that there are successive sections entitled: 1, 1.2, 1.3 and 1.4. This demonstrates that the measure depicted is four beats in duration. As is well-known in the art, the currently selected audio portion may be altered by "grabbing" the end of the currently selected audio with a mouse (the right end) and moving it to the left or right to thereby select less or more audio, respectively.

Still referring to FIG. 1, element 102 represents one full beat of the measure. There are four individual divisions of this section (each is one 16th note in length, four 16th notes is equivalent to one quarter note). Here, the quarter note depicted in section 102 is divided into four 16th notes. Alternatively, the divisions may be used to indicate any size of note or tone. Also, the quarter note depicted (or any other length of note or tone) may be divided into any number of portions, such as $16^{th}$ notes, $32^{nd}$ notes or $256^{th}$ notes. It is to be understood that the division of a quarter note into four $16^{th}$ notes is used only as an example. Notes or audio of any length may be used or selected prior to applying the micro edit methodology described in this invention. Additionally, the selected audio to which a micro edit is applied may be lengthened or shortened subsequent to the application of the micro edit.

In alternative examples using the same embodiment, the quarter note (or other note) selected may be subdivided into any number of subdivisions. Element 104 is, therefore, a single 16th note's span of time. The selected section 102 is a full quarter note. The quarter note selection is used for purposes of an example. In the preferred embodiment of this invention, any selection of any number of subdivisions could be used. For example, a user could select to create a micro edit for an audio portion representing only three of the 16th notes in that quarter note time. Alternatively, the measure could be divided into 32nds and a user could select a single 16th note to create a micro edit. Alternatively, a user may select any length of note, $32^{nd}$ note, $256^{th}$ note, a half note, or select any other length of audio time to which to apply a micro edit including any number of subdivisions (micro events). Alternatively, a user could select multiple measures or portions of measures and still make use of the method and apparatus of this invention.

Figure 2:
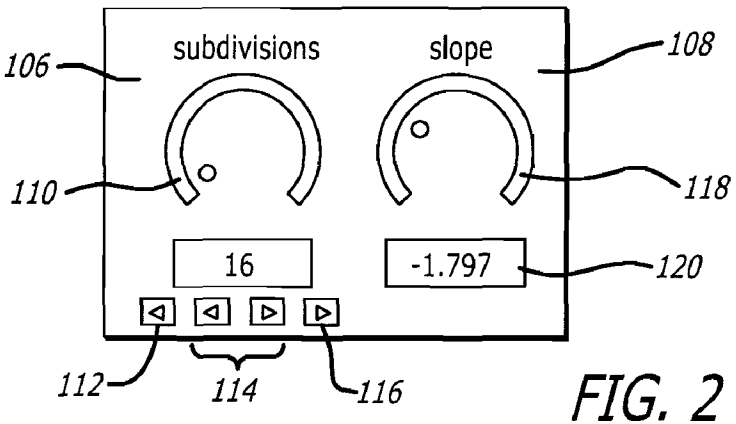
FIG. 2 shows a manipulation control for use in creating and manipulating "micro edits."

Referring now to FIG. 2, once a user has selected a portion of a track (as depicted in FIG. 1) to create a micro edit, the user may then use the graphical user interface depicted in FIG. 2 to create a "micro edit" of the audio portion of that selection. A micro edit is an edit of the sound of a particular portion of an audio track (or the entire track) that is accomplished, in the preferred embodiment, by subdividing. In the preferred embodiment, an eight-part alteration of the selected audio portion may be made. The options for alteration of the sound using a micro edit include: number of subdivisions, slope of the events, amplitude of the curve (including start, end and slope) and the gate curve (including start, end and slope). Each subdivision of a micro edit is called a "micro event."

In FIG. 2, the graphical user interface for selecting the number of subdivisions (or micro events) 106 is depicted. Also depicted is a dial 118 for use in setting the slope 108 of the micro edit. The dial for selecting the number of subdivisions is shown in element 110. The slope of a micro edit may take any one of many forms. In alternative embodiments a user may select a user-defined slope by means of simply clicking at various points within a graphical display to thereby create break points within a line that is the slope. In yet another alternative embodiment, a series of "magnets" may be applied to a graphical display, whereby micro events (the waves in FIG. 5) are "attracted" to the magnets to thereby create the micro edit. Micro events then "cluster" around the magnets to thereby create groupings of micro events across the micro edit.

There is a display of the number of subdivisions immediately below this dial. The arrows underneath the dial may be used to fine tune the selection. The first arrow 112 is used to jump to the front of the options. Here, that would be to create a single subdivision. The fourth arrow, conversely, is used to jump to the end. In the preferred embodiment this number is 255 subdivisions, though it may be any number of subdivisions. Finally, the second and third arrows 114 are used to move one subdivision more or less.

The slope 108 selector dial 118 is used to set the slope of the micro events. The method of this invention divides up a sound into a number of subdivisions and provides silence (or spacing when represented visually) between the micro events. This slope selector dial 118 controls the exponential slope of the micro events across the selected sound time period (one beat in the example of FIG. 1). A negative slope will cause the micro events to occur more rapidly at the beginning of the micro edit. A positive slope will cause them to occur more slowly at the beginning (rapidly at the end). The "slope" number input here in element 120. There is a two-part method for generating the microevents. For slope less than or greater than zero, the following method is used:

$$y=m1*(1.0-\exp(t*m2))$$

where $$m1=dy/(1.0-\exp(\text{alpha}))$$

$$m2=\text{alpha}/dt$$

y is the amplitude (or height) of the wave dy is the sound output range dt is the length of time of the entire micro edit alpha is a value between −5 and 5 which determines the way in which the subdivisions skew The exp(n) function in computer science returns the exponential value of the base of natural log raised to the power n.

Figure 3A:
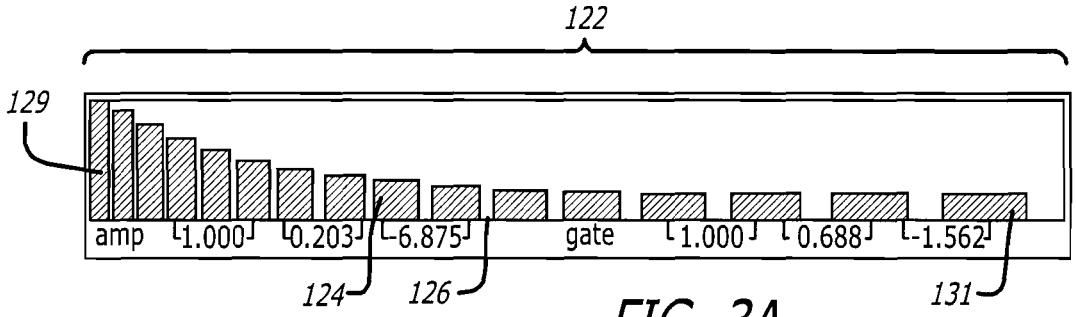
FIG. 3*a* is a graphical representation of a sound subjected to the micro edits of FIG. 2.
Figure 3B:
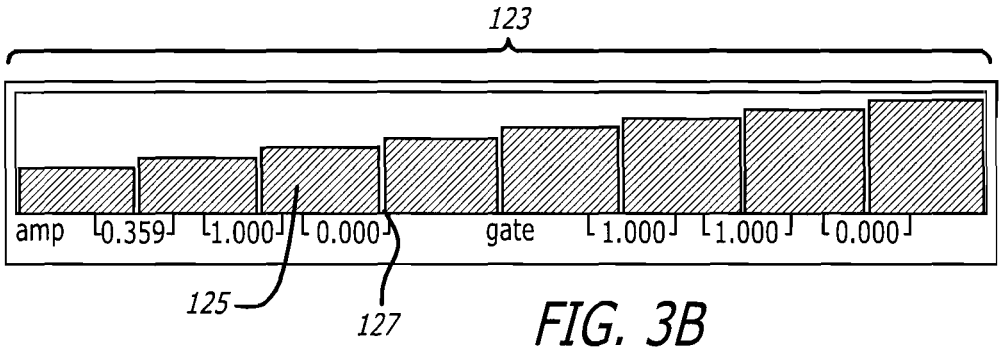
FIG. 3*b* is a graphical representation of a sound produced by a linear micro edit.

If slope is zero, then the subdivisions occur linearly instead of exponentially as follows:

$$y=(dy/dt)*t$$

where y is the amplitude (or height) of the wave dy is the sound output range dt is the length of time of the entire micro edit Referring now to FIG. 3A and 3B, the result of this formula is to create a slope from the start of the micro edit to the end, audible (or visible in the visual representations in the Figures) across all of the micro events in the micro edit for the sound waves. FIG. 3A depicts the micro edit (and all micro events) of FIG. 2. The slope that was input in element 120 of FIG. 2 is negative, therefore, the micro events occur more rapidly at the beginning of this event. As is apparent, across all of the visual representations of these micro events in element 122, they occur very rapidly at first and much slower toward the end of the micro edit. Also of note, within the micro edit depicted in element 122, there are precisely 16 micro events (represented by the lighter, solid bars). These 16 bars correspond to the 16 subdivisions from FIG. 2. One of these micro events is shown in element 124.

Still referring to FIG. 3A, a "gate" is depicted in element 126. A gate 126 creates a gap in between the micro events. The gate 126 is denoted by the absence of the selected sound which is being edited by this micro edit. Each gate 126 provides a signal requesting that each micro event, within the micro edit come to an end, entering its release stage (described with reference to FIG. 4, thereby creating the appearance of gaps in the sound. The gate may also have a slope. This slope is determined separately form the slope for micro events, but is a part of the overall effect generated by the method and apparatus of this invention. The same algorithm described above for generating the slope of the micro events is used to generate the slope of the gates 126. As can be seen, the selected slope of this gap is also negative. This is apparent because the gates 126 are small at first and then they become larger toward the end. As mentioned above, the gate curve has input parameters, in addition to the slope parameter, for start and stop. These two parameters determine the width of the first gate 126 and the last gate 126, then exponentially (or linearly, if selected) scales the gates 126 between those two events (or start and end point).

Still referring to FIG. 3A, it can be seen that over the course of the micro edit depicted in element 122, the amplitude (wave height) of the micro events also decreases over the course of the micro edit. This variation in amplitude is also generated by the algorithm of this invention. A negative slope will result in beginning from a high amplitude and descending to a low amplitude. This can be seen in element 129 wherein the amplitude is very high. Subsequently, the amplitude of the sound becomes much lower, as is seen in element 131. A positive slope will result in a lower amplitude that ascends to a higher amplitude. Similarly to the gate parameters above, the amplitude setting also has two other parameters besides slope. These two parameters are start and stop, these are the starting and stopping amplitudes (visually represented as in FIG. 3A as the highest and lowest bars at the far left, element 129, and far right, element 131). These determine the endpoints for the exponential extrapolation of the formula described above (for use in determining the "dt"). The algorithm described above with reference to the micro events is used to exponentially or linearly extrapolate from the start point to the end point.

FIG. 3B is an alternative linear extrapolation, over a micro edit 123, using the method and apparatus of this invention. In this case, it is apparent that the slope is zero (and thus linear) because the micro events, such as element 125, are all of equal size and occur at the same, regular interval. The gates, an example of which is depicted in element 127, of this extrapolation are also linear, being equally spaced and the same size. Finally, the amplitude of this example is linearly increasing from left to right. If it were exponentially increasing, the bars would appear to create a "curve." As they are not, this is a linear example.

The method of this invention also provides that this gate, amplitude and micro event data is maintained within an array database (or other similar means). Therefore, when the micro event is lengthened or otherwise altered, the algorithm of the present invention can be reapplied immediately to the micro event and any co-dependant or related micro events such that it is automatically updated. Another example would be a global time signature change. A change from 4/4 time to 3/4 time could effect every micro edit in the audio track or mix. Every micro edit affected would be immediately updated to reflect these changes. For example, as the user applies the method of stretching a selection (described with reference to FIG. 1), the micro edit and each micro event (subdivision) is applied, using the same algorithm as has been previously defined by a user, to the newly-selected data. If the user has created a pre-defined micro edit with regard to an audio selection and the user subsequently alters the portion of audio selected in time or length of the audio selected, the micro edit is applied to the newly-selected audio in the same way it was previously applied to the originally-selected audio.

As can be understood, "slope" refers to any curvature or other waveform capable of designation by a user, through any number of means. Alternative methods of defining the slope of these various elements may be used. In alternative embodiments, user-defined slopes may be created using a graphical user interface. These user-defined slopes may be created by clicking at various locations to thereby create a series of micro events along the micro edit. In yet another alternate embodiment, a series of micro edit "magnets" may be applied to a graphical user interface representing the selected audio portion. These magnets attract micro-events such that the slope is user-defined, but according to an algorithm designed to vary according to the number of magnets applied.

Figure 4:
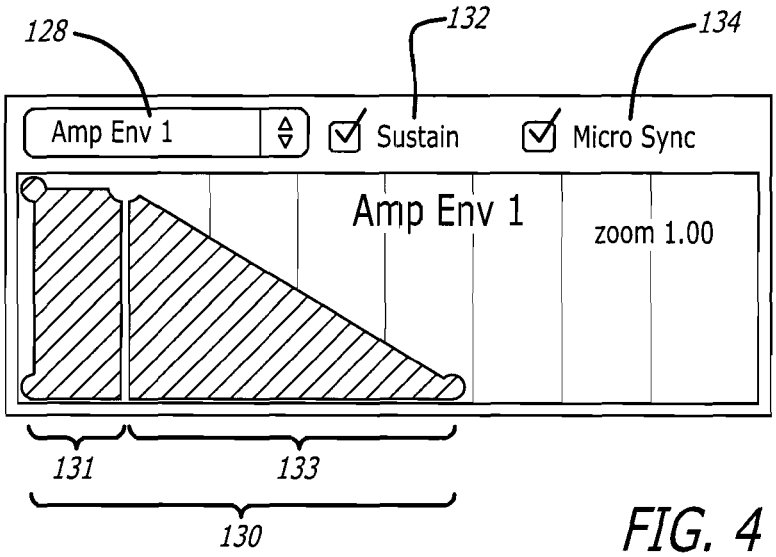
FIG. 4 is a depiction of the audio amplitude envelope.

Referring now to FIG. 4, the method and apparatus of this invention provides means by which "voice stealing" may occur. "Voice stealing" is a method whereby as sound is being output but is fading out or is background, the sound creation or modification device determines which voices should have the focus and automatically fades out the unnecessary voice or voices, thereby providing a "voice" for an incoming focus or important sound.

So, for example, there are two voices operating, one providing a melody and another providing a subtle overtone. In another measure, a strong baseline is about to come into the audio. The method of voice stealing would provide that, for the measures that the strong baseline is required, the subtle overtone's "voice" may be stolen for delivery of the more important (for the moment) sound.

Voice stealing is common in the art, dependent upon the number of voices provided by a given piece of hardware or software. Some computer audio cards are capable of thousands of voices (if necessary). However, in the field of drum machines or audio manipulation software and plugins, more than two voices are not typically used. Therefore, providing a reliable method of voice stealing is even more important than in other fields.

Still referring to FIG. 4 a depiction of the graphical user interface for setting the amplitude envelope for a particular audio event is depicted. In the case that the software detects that an audio event is about to overlap with another upcoming audio event, the software will review the amplitude envelope 130 of each audio event to determine the way in which it should voice steal. If the amplitude envelope 130 is not short enough and the voice will have to be stolen, the method and apparatus of this invention will attempt to end the audio event as smoothly as possible in consideration of the new upcoming audio event's timing.

Still referring to FIG. 4, the amplitude envelope selector 128 is depicted. It displays "Amp Env 1". The displayed element is a dropdown list of each available amplitude envelope for each audio event that has been created. The amplitude envelope is set by an envelope generator after being graphically predetermined by a user using this graphical user interface in the preferred embodiment. Using this envelope, the user sets a sustain if desired by checking the checkbox 132. This sustain component of the audio envelope is visible in element 131. The release stage 133 is the stage that releases the voice at the end of the micro event. A user need not use micro event amplitude envelopes at all if they are not desired. However, they are useful to "smooth out" the transition from audio output to silence. Finally, the micro sync 134 checkbox provides means by which the amplitude envelope is applied, individually, to each micro event within a micro edit.

Micro events may be strung together in the preferred embodiment of this invention. There are three available amplitude envelopes which may run simultaneously in the preferred embodiment. These amplitude envelopes may overlap, but there are only two voices available (in the preferred embodiment, there may be more in alternative embodiments) at any given time to use for these envelopes.

The voice-stealing of the present invention is implemented using the amplitude envelope of the various audio events. If it is determined that one amplitude envelope will overlap with another (while another is still going on), the first's voice will be stolen. This is determined by first attempting to find an amplitude envelope that is already in its release stage (decreasing in amplitude). If this is not possible, the method of this invention will find the one who's amplitude envelope is ending soonest.

Once this soonest ending amplitude envelope is found, the next micro edit start time is set as the time at which the current amplitude envelope must end. The method of this invention looks to determine if there is time for a 20 millisecond release, referred to as an "ideal early release." The release stage of the amplitude envelope is then linearly extrapolated from its current position to the time at which the voice must be released to be stolen by the upcoming micro edit.

Figure 5:
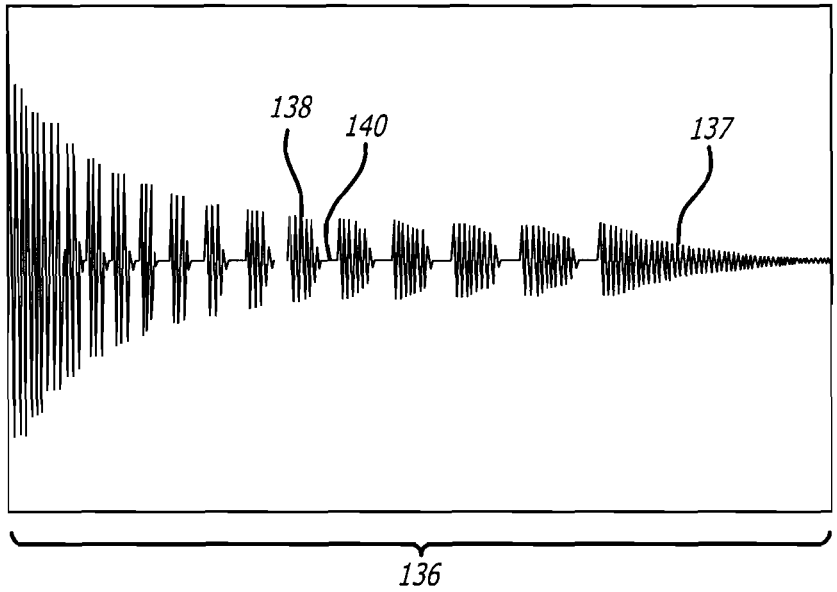
FIG. 5 is a depiction of a sound wave output resulting from the micro edits depicted in FIG. 3*a*.

Referring now to FIG. 5, a visual representation of the sound produced by the micro edits of FIG. 2, 3A and 4 is shown. Element 136 is the entire measure depicted in element 102 of FIG. 1. The number of subdivisions selected in FIG. 2, sixteen is also shown. The slope of the sound produced during this measure corresponds to the slope input in FIG. 2 as well. Using the algorithm described above with reference to FIG. 2 (and visually depicted in FIG. 3A), the sounds of the measure 102 (see FIG. 1) are shown. Depicted are the subdivisions, for example in element 138, and the gates, for example in element 140. Also depicted is the amplitude envelope, depicted in element 137. Element 137 corresponds to the amplitude envelope of FIG. 4.

Figure 6:
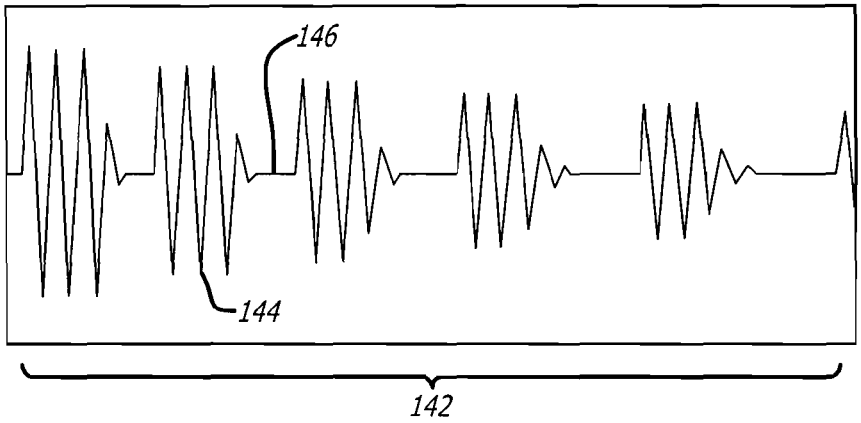
FIG. 6 is a close-up depiction of a portion of the sound wave output depicted in FIG. 5.

Referring now to FIG. 6, a depiction of a portion of a measure 142 is shown. This is a close-up or "zoomed-in" view of a portion of the measure depicted in FIG. 5. More readily visible are the subdivisions, for example in element 144, and the gates, for example in element 146. These sounds are produced as sine waves utilizing precisely timed to the number of subdivisions and gates requested by the user of the method and apparatus of this invention. These sine waves are visible in the subdivision 144 and stop at the gate event depicted in 146.

Figure 8:
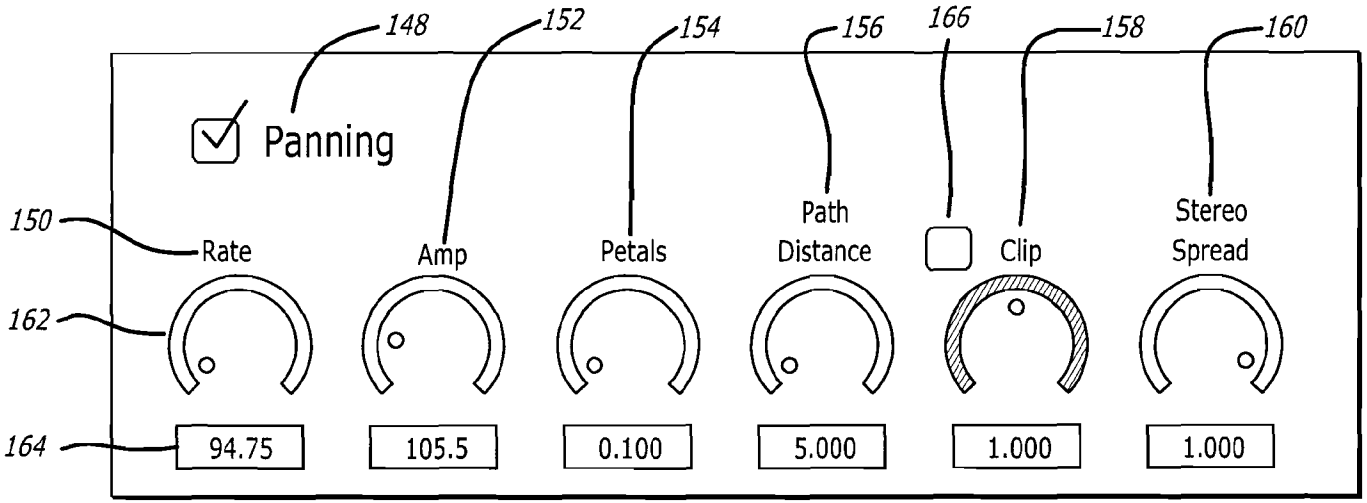
FIG. 8 is a depiction of a portion of panning control of the graphical user interface.

Referring now to FIG. 8, a depiction of the panning control of the graphical user interface is depicted. This element provides graphical "knobs" for use in creating any number of shapes or elements in two dimensions with sound. The interface is designed to provide extensive control while maintaining ease of use. The various elements of these controls provide functionality for the manipulation of a selected sound, track or portion of a track within a two-dimensional sound space such as Dolby® 5.1 surround sound.

Figure 7:
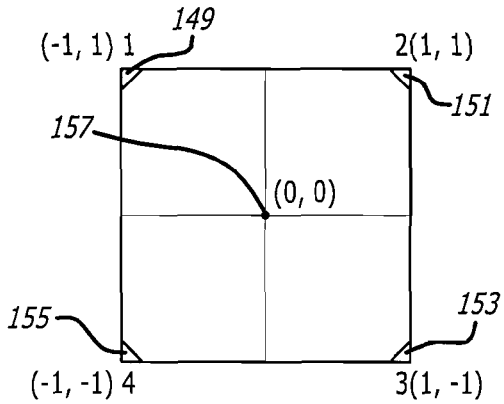
FIG. 7 is a depiction of an example 5.1 surround sound system of the preferred embodiment.

The controls depicted in FIG. 8 are used to input values which are used to create "shapes" and "paths" of sound in the two-dimensional space. For purposes of this invention, a two-dimensional space is created, a representation of which is depicted in FIG. 7, for the speakers of a surround sound system. In this abstract space, there are 6 speakers in the preferred embodiment. The first speaker 149 is placed at front and left, the second speaker 151 is placed at front and right, the third speaker 153 is placed at the back and right and the fourth speaker 155 is placed at the back and left. There are also center and base channels, but these are not used in the preferred embodiment of this invention for panning. Typically, the center channel is placed directly in front of the center, between the first speaker 149 and second speaker 151.

In creating this space, the algorithm used in the preferred embodiment of the present invention places the speakers described above at abstract locations. The location of the first speaker 149, for example is placed at the Cartesian coordinate (−1, 1). The second speaker 151 is placed at (1, 1). These can be seen in FIG. 7. The method and apparatus of this invention utilizes an algorithm whereby the path of the sound as it pans through the two-dimensional space is determined using a polar coordinate system. Subsequently, this polar coordinate system is transformed into Cartesian coordinates ranging from (−1, 1) to (1, 1) so that they fall within the abstract space depicted in FIG. 7.

The algorithm used in the preferred embodiment is as follows:

```
thetaRate=(rate/sample rate)*2.0*pi
```

rate is the rate at which the panning occurs (described more fully below)

pi is the mathematical constant that is the ratio of the circumference of a circle to its diameter.

The resulting thetaRate is the speed at which the pathing takes place. This is used subsequently to create an array of "points" within the two-dimensional space. The following algorithm is used to create the series of phase angles used to make the path in two dimensions:

```
For i = 0 to num frames
    theta[i] = index
    index = index + thetaRate
    if (index > pathDistance) index = index − pathDistance
```

The resulting array theta[i] is a series of phase angles used to generate the path of the sound within the two-dimensional space. To generate the path array, the following algorithm is used:

```
r[i] = amp * cos(number of petals * theta[i])
```

where:

amp is the radius of the path (distance from the middle of the abstract space);

number of petals is a number that controls the shape of the resulting pan (described more fully below); and theta[i] is the array of phase angles created above.

The resulting r[i] is an array designating the path in polar coordinates. As is well-known in the art, to convert this path array into Cartesian coordinates, the following algorithm is used:

```
x[i] = r[i] * cos( theta[i] )
y[i] = r[i] * sin( theta[i] )
```

where:

x[i] is an array of x coordinates designating the panning path; and y[i] is an array of y coordinates designating the panning path.

Finally, the distance from each of the four corner speakers (in abstract space) is determined using a distance formula such as:

```
distance = sqrt ( (dx * dx) + (dy * dy) )
```

This distance value is used to determine the amplitude of the sound at a given location. If the distance is large, the amplitude is low (creating sound that "feels" further away when heard). If the distance is small, the amplitude is larger (creating a sound that "feels" much closer).

Now referring to FIG. 8, the controls of the preferred embodiment of the present invention is depicted. These controls are used to designate the input values for the algorithm described above. The first element depicted is the panning checkbox 148. This checkbox is selected in the graphical user interface if a user wishes to utilize the method and apparatus of this invention to cause a selected portion of sound to "pan" within the surround sound space. Next, is the rate 150 selector. In this graphical user interface, the rate 150 selector and other selectors are depicted as a knob 162. This is only used as an example. In alternative embodiments, the user may use dials, scroll wheels, number input, checkboxes or virtually any other graphical component to manipulate the input. In the preferred embodiments, knobs, such as the one depicted in element 162 are used.

The rate 150 refers to the travel speed or travel rate of the selected sound within the two-dimensional space. The rate number selected is the rate in Hertz. In element 164 a rate of 94.75 Hz is selected. The method and apparatus of this invention is capable of manipulating the "position" of the selected sound within the two dimensional space over time. So, for example, a sound may "move" across the two dimensional space over the course of a measure, portion of a measure or the entire song. The rate 150 selector is used to control the rate of this movement within the two-dimensional space. This can be better understood through the use of an example, such as the sound panning depicted in FIGS. 10 through 13.

The amp 152 selector controls the radius of the path of the sound within the two dimensional space. So, if the selected "shape" of the movement path (as determined by the remaining selectors) were simply a circle of sound, moving within the two-dimensional space, then this would be the measure of the distance from the center of the two dimensional space to the "position" of the selected sound's path. So, for example, if the speakers were positioned 100 feet apart from each other (left to right) and the amp selector 152 were set to 100 (feet), then the radius of the circular path of the sound created by the method and apparatus of this invention would be 100 feet. As described above, the rate selector 150 would determine how quickly the selected sound "circles" the center of the room.

Next, the petals 154 selector is depicted. This element provides a selector for the cosine theta of the algorithm utilized to create the petals of this invention. A larger cosine theta will create more "petals" of sound. For examples of "petals" refer to FIG. 10. As can be seen in this Figure, the path of the sound follows the white area designated by element 178. The sound is not "present" in that white area, it moves along that white area over time. The method and apparatus of this invention creates audio panning in two dimensional space such that the sound moves across that space according the algorithm described with reference to FIG. 7. The higher the "petals" selection in element 154, the more places the sound will be moving through.

Next, the path distance 156 selector is shown. This determines the length of the path. In the algorithm described above, this is the pathDistance variable. So, the sound path will be created using the method described above with reference to FIG. 7 for a distance (integer distance in the preferred method of this invention) up to the value input using the path distance selector 156. At the end of this distance, the sound's path or panning, absent other instruction, will repeat itself. So, if the path distance only takes ⅓ of the time that a given panning path is designated for, the sound selected and generated will move across this path three times before this panning path designation ends.

Next, a clip 158 selector is depicted. Also included is a checkbox 166 for the clip 158 selector. The checkbox 166 is used to enable or disable the clip 158 selector. By default, in the preferred embodiment, the clip 158 selector is not enabled. The clip 158 selector enables the sound path to move outside of the abstract two-dimensional space. So, for example in FIG. 11, portions of the sound, designated by the lighter dots, such as element 186, fall outside of the space. This creates sound that "feels" far away from all of the speakers, as if it is outside the room. In some sound generation a user may not wish the sound to "feel" as if it is outside of the room, however the clip 158 selector option is provided for this purpose. The clip 158 is the Cartesian distance at which sound will be allowed to go outside the abstract two-dimensional space before being "clipped" to the edge of that space.

Finally, the stereo spread 160 selector is shown. The stereo spread 160 is used to offset the base input signals (the base signals in the preferred embodiment are stereo, therefore two channels) along the x-axis of the Cartesian coordinates. This can "spread" the sound out along the x-axis or make the sound very close together. If the stereo spread 160 selector is set to 1.000, then no alteration to the sound "spread" is made.

Figure 9:
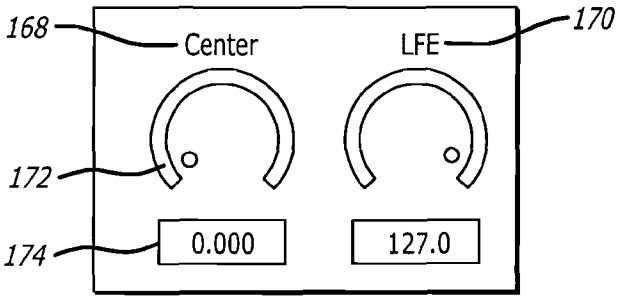
FIG. 9 is a depiction of centering control.

Referring now to FIG. 9, two additional selectors are shown, the center 168 selector and the LFE 170 selector. The center 168 selector also has a control knob 172. As above, any method of altering the value depicted in element 174 may be used. The center 160 selector is used to determine the gain on the center channel. In the preferred embodiment, utilizing the Dolby® 5.1 sound, there is a center channel, typically designated to be in the front-and-center of the abstract two-dimensional space described in FIG. 7. This control, separate from the algorithm described above, provides the amount of volume that will be sent through the center speaker.

LFE 170 refers to the sixth speaker in the typical 5.1 setup. This is the low-frequency speaker or subwoofer. The value depicted in element 176 is the gain provided to that channel of the low-frequency sound. The LEF 170, along with the center 168 are both controlled apart from the algorithm described with reference to FIG. 7.

Now referring to FIG. 10, a visual representation of the panning algorithm in use is depicted. The white area, designated in element 178 is the path of the sound. Element 180 is the "center" of the sound panning. As can also be seen, element 179 is the abstract two-dimensional space depicted in FIG. 7. In this depiction, the white area is the total path, for the entire path distance, of the sound. The method and apparatus of this invention provide means that "pan" the sound, over time, across this two-dimensional space.

For example, at time=1 second, the sound may be at the origin (0, 0) and at time=2 seconds, the sound may be at (0.5, 0.5) in Cartesian space. To a listener, this would appear as if, apart from the basic sound being generated by the method and apparatus of this invention, that the sound was "moving" in the shape designated by the user of this method and apparatus. In FIG. 10, the shape is that of a flower with four petals or two overlaid FIG. 8's. The experience of creating panning sound using so simple a control for the user is not known in the prior art. Also depicted in this FIG. 10 are the amplitudes 182, over time, of the sound in each quadrant of the two-dimensional space. As the sound moves "into" a quadrant, the amplitude in that quadrant grows larger, as it moves out of it, it grows smaller. This is apparent in element 182.

This visual representation of the sound experience is provided in real-time to a user of the method and apparatus of this invention. As a user turns the "knobs" depicted in FIGS. 8 and 9, the sound panning path is altered and "visible" to the user. This visibility and simplicity in creating complicated audio patterns across a two-dimensional sound space is not known in the prior art. Further examples are depicted in the following figures.

Next, referring to FIG. 11, an alternative two-dimensional sound creation is depicted. Here, notably, the center 184 has been offset toward the first speaker. Also, the path of the sound is lengthy, clipping outside of the two-dimensional space. Furthermore, the rate of the path is so high as to create sounds which do not appear to create "lines" of paths, instead they create "dots" of sound, such as the "dot" depicted in element 186. To a listener, the sound created using this algorithm would appear to swirl toward the center 184 from the outside then would again sound far outside the four speakers only to swirl into the center 184 again. The sound could also be described as "raindrops" of sound around an individual within the two-dimensional space. As above, the amplitudes over time of the given path are shown in element 188.

Figure 12:
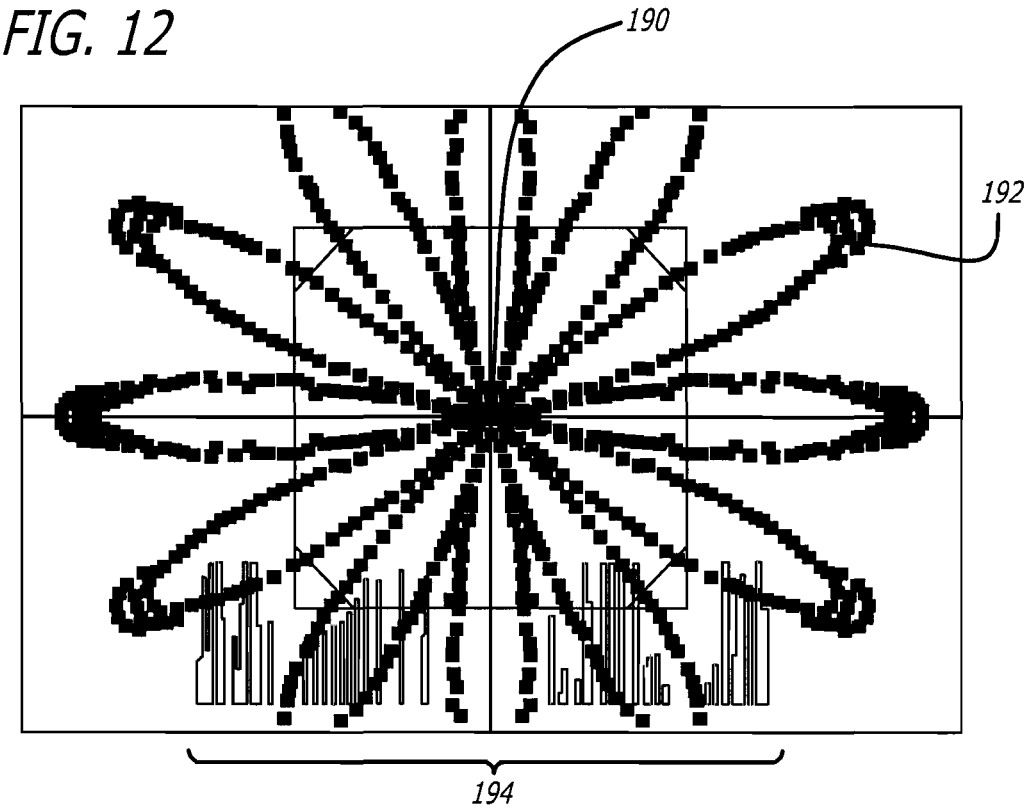
FIG. 12 is another graphical depiction of the placement of sound within an example surround sound space.

Referring now to FIG. 12, a further example sound panning path is depicted. This example has its center 190 in the actual center of the two-dimensional space, unlike FIG. 11. Additionally, this sound-path would appear to a listener to encircle them much more than the example pattern shown in FIG. 11. This example is a path with 12 "petals." The sound path, a portion of which is designated by element 192, radiates outward from the center 190 and returns to the center 190 twelve times over the course of the path. As can be seen, the dots are spaced such that they do not create, as in FIG. 10, a visible line, but they do follow a distinct and discernable pattern. As above, the amplitudes in each quadrant over time are depicted also in element 194.

Figure 13:
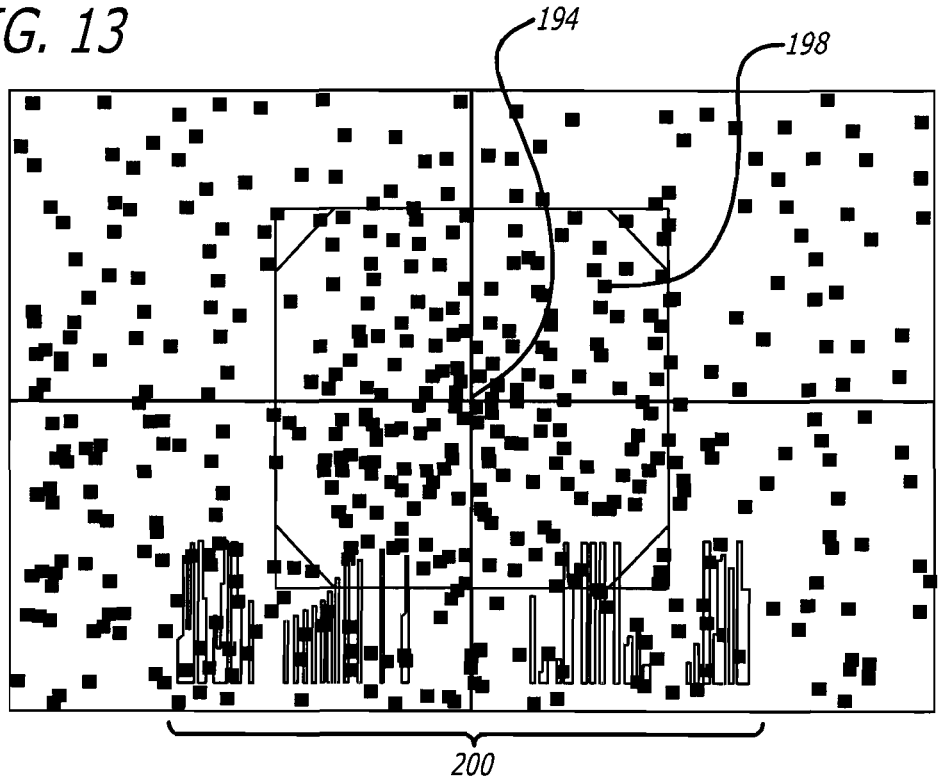
FIG. 13 is another graphical depiction of the placement of sound within an example surround sound space.

Referring last to FIG. 13, the center 196 of the sound is in the actual center of the two dimensional sound space. Each of the sound "dots," an example of which can be seen in element 198, occur at various places around the two-dimensional sound space and outside of it. In this example, the clip function must be enabled and must be set to a large distance. There are numerous sounds, depicted as white dots, that fall outside the two-dimensional sound space. This pattern is also generated using the method and apparatus of this invention. The sound in this example would appears virtually exactly to a listener as "raindrops" of sound. The sound is occurring intermittently all around a listener in this sound space. The user of the software can visually "see" what his listener will be hearing in real time. This is not known in the prior art. As above, the amplitude of the sound in each Cartesian quadrant is depicted in element 200 at the bottom of the visualization of FIG. 13.

It will be apparent to those skilled in the art that the present invention may be practiced without these specifically enumerated details and that the preferred embodiment can be modified so as to provide additional or alternative capabilities. The foregoing description is for illustrative purposes only, and that various changes and modifications can be made to the present invention without departing from the overall spirit and scope of the present invention. The present invention is limited only by the following claims.

What is claimed is:

1. A computer-based method of audio generation and manipulation comprising the steps of:

selecting one or more adjacent previously defined subintervals from one or more adjacent measures of a respective audio track of an audio stream to thereby define a micro edit time interval that is repeated in subsequent measures in accordance with a defined time signature;

designating a number of micro events into which said micro edit time interval will be divided;

setting a micro edit slope which determines how the distribution of the individual micro events is varied in time within the micro edit time interval; and creating an edited audio track with said designated number of micro events distributed in accordance with the same said designated micro edit slope for each subsequent occurrence of said micro edit time interval;

setting a starting gap width for a first gap adjacent a first said micro events;

setting an ending gap width for a last gap adjacent a last said micro event, said starting gap width being different than said ending gap width; and designating a gap slope for the width of intermediate gaps between said first gap and said last gap.

2. The method of claim 1, wherein said micro edit slope is exponential.

3. The method of claim 2, wherein said micro edit slope is user-defined.

4. The method of claim 2, wherein said micro edit slope is defined by the placement of one or more user-defined locations within the micro edit time interval.

5. The method of claim 1, wherein said micro edit slope is linear.

6. The method of claim 1, further including the steps of:

setting an amplitude starting point for said micro edit time interval;

setting an amplitude ending point for said micro edit time interval; and designating an amplitude slope for the amplitude of said micro edit time interval.

7. The method of claim 1, wherein said audio track is output from a drum machine, said method further comprising the additional steps of:

changing said time signature; and using the previously designated number of micro events and the same selected micro edit slope to thereby cause the drum machine to output a newly edited audio track with the changed time signature.

* * * * *